US011446729B2

(12) United States Patent
Lücke et al.

(10) Patent No.: US 11,446,729 B2
(45) Date of Patent: Sep. 20, 2022

(54) METHOD FOR THE PRODUCTION OF AN INTERNAL STOP IN A TUBULAR COMPONENT

(71) Applicant: Benteler Steel/Tube GmbH, Paderborn (DE)

(72) Inventors: Daniel Lücke, Brakel (DE); Michael Markert, Lichtenau (DE); Marcel Wellpott, Paderborn (DE); Dirk Tegethoff, Salzkotten (DE)

(73) Assignee: Benteler Steel/Tube GmbH, Paderborn (DE)

( * ) Notice: Subject to any disclaimer, the term of this patent is extended or adjusted under 35 U.S.C. 154(b) by 0 days.

(21) Appl. No.: 17/545,630

(22) Filed: Dec. 8, 2021

(65) Prior Publication Data

US 2022/0176436 A1 Jun. 9, 2022

(30) Foreign Application Priority Data

Dec. 9, 2020 (DE) ..... 10 2020 132 822.2

(51) Int. Cl.
*B21D 39/04* (2006.01)

(52) U.S. Cl.
CPC ..... *B21D 39/048* (2013.01)

(58) Field of Classification Search
CPC ..... B21D 41/00; B21D 41/02; B21D 41/04; B21D 39/20; B21D 39/06; B21D 39/08; B21D 39/048; B21K 21/00; B21C 37/16; B21C 37/153; B21C 37/107; B21C 37/0807; B21C 37/0803; B21C 37/06; B21C 37/15
See application file for complete search history.

(56) References Cited

U.S. PATENT DOCUMENTS

| | | | | |
|---|---|---|---|---|
| 2019/0275980 | A1* | 9/2019 | Wellpott | B60R 21/26 |
| 2020/0094773 | A1 | 3/2020 | Lücke et al. | |
| 2021/0002749 | A1* | 1/2021 | Christophliemke | F16L 9/006 |

FOREIGN PATENT DOCUMENTS

| | | | | |
|---|---|---|---|---|
| DE | 102015014503 | | 5/2017 | |
| DE | 102018105445 | | 9/2019 | |
| DE | 102018106546 | | 9/2019 | |
| DE | 102018123316 | | 3/2020 | |
| DE | 102019103926 | | 8/2020 | |
| WO | WO-2009003498 | A1 * | 1/2009 | B21C 1/26 |

* cited by examiner

*Primary Examiner* — Lee A Holly
(74) *Attorney, Agent, or Firm* — Henry M. Feiereisen LLC

(57) ABSTRACT

An inner diameter of a first end of a tubular component, positioned in relation to a first die, is reduced through relative movement between the tubular component and the first die such as to produce a first conical area between first and second ends of the tubular component. The first conical area is then formed through relative movement of a second die to create in a longitudinal section of the first conical area an outer circumferential embossment and an inner bead having an inner diameter smaller than the inner diameter of the first end. The first end is widened through insertion of an inner tool, while the tubular component is supported on an outside in a mold cavity of an outer tool. An inner contour with an internal stop is formed as an outer surface of the first end of the tubular component rests flatly in the mold cavity.

12 Claims, 6 Drawing Sheets

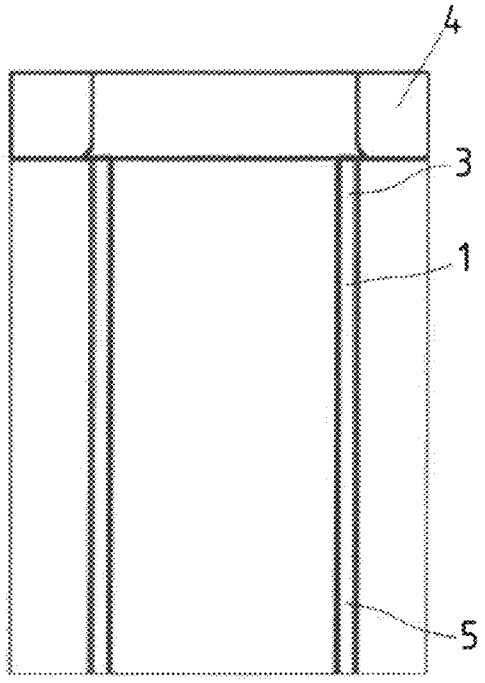
Fig. 2.1
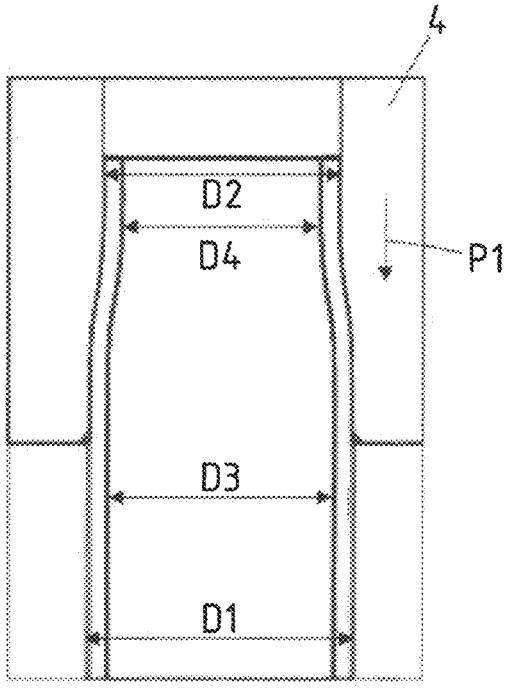
Fig. 2.2
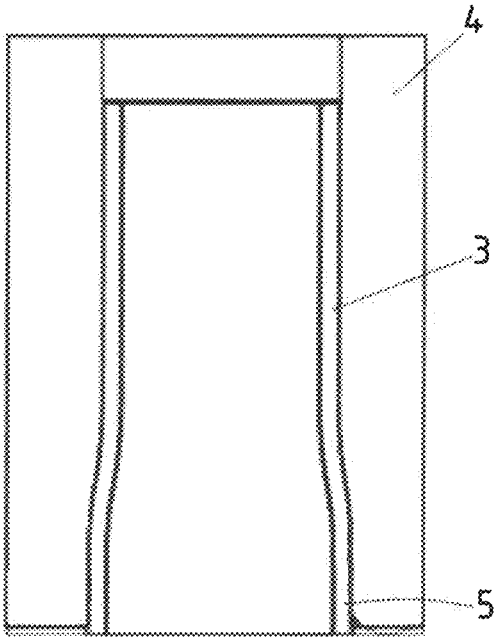
Fig. 2.3
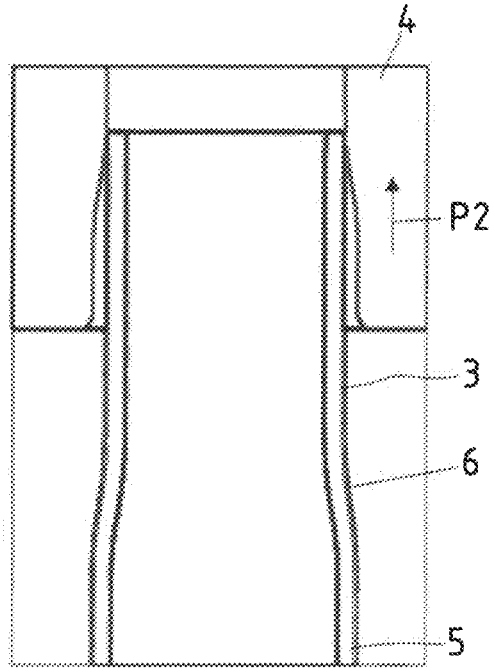
Fig. 2.4

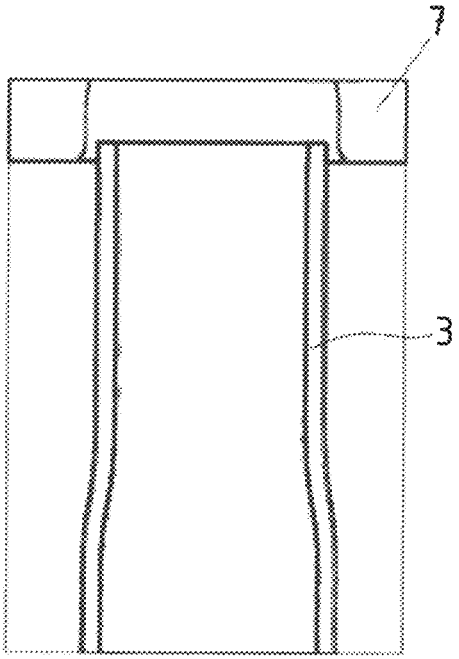
Fig. 3.1
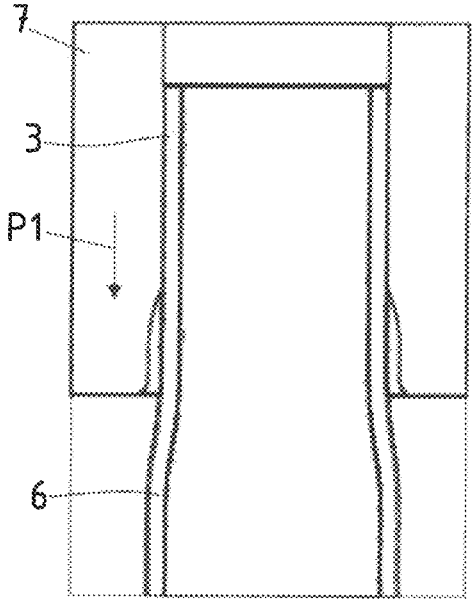
Fig. 3.2
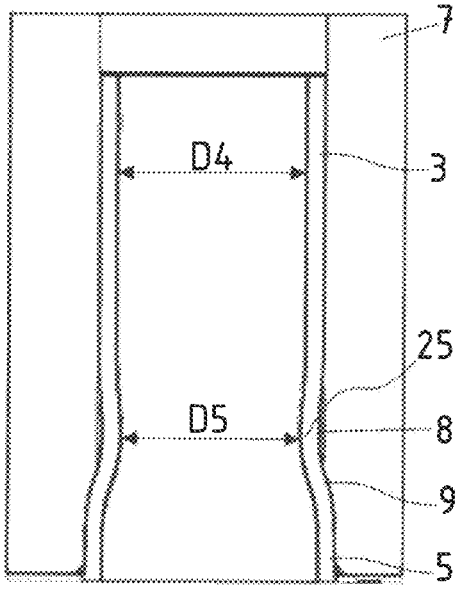
Fig. 3.3
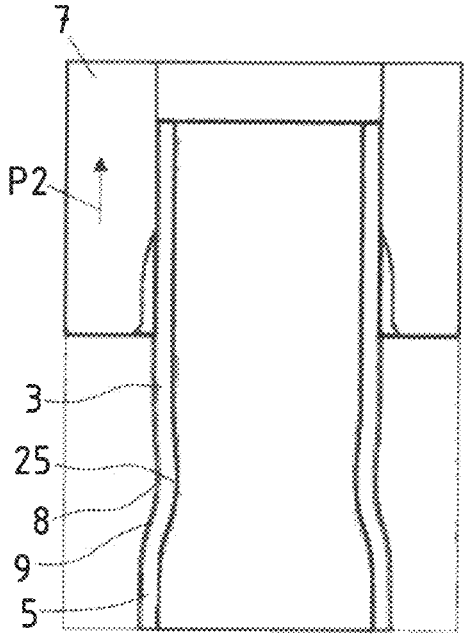
Fig. 3.4

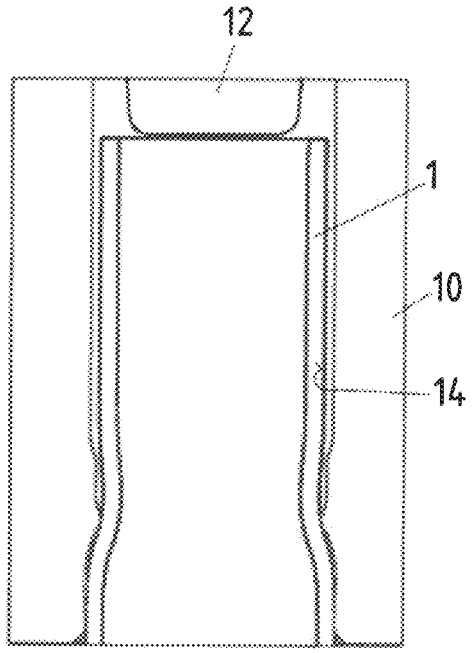
Fig. 4.1
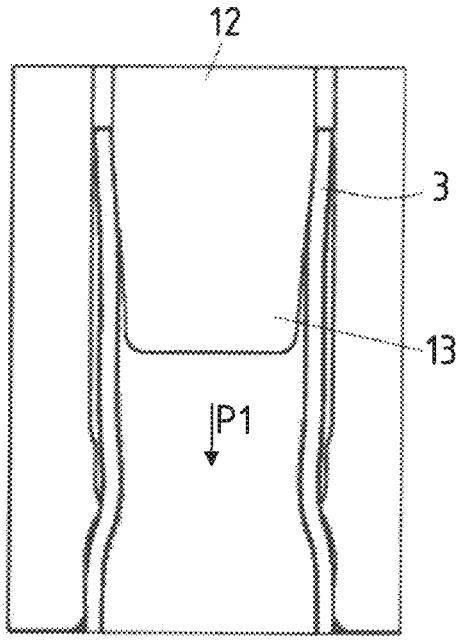
Fig. 4.2
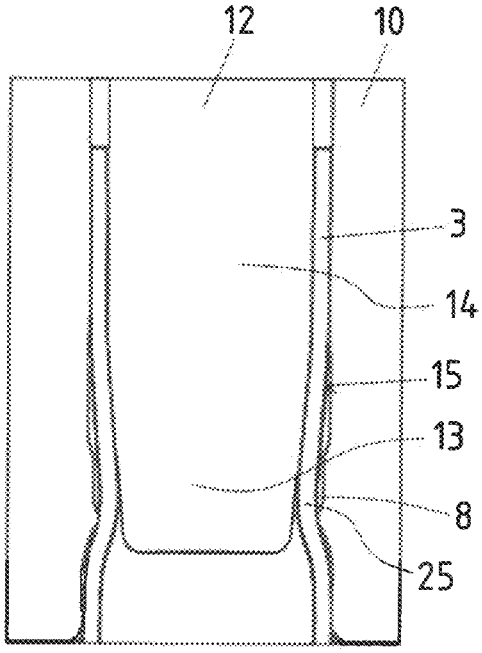
Fig. 4.3
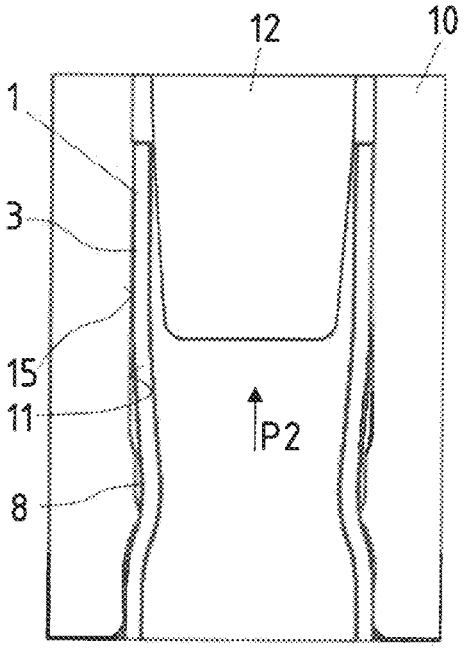
Fig. 4.4

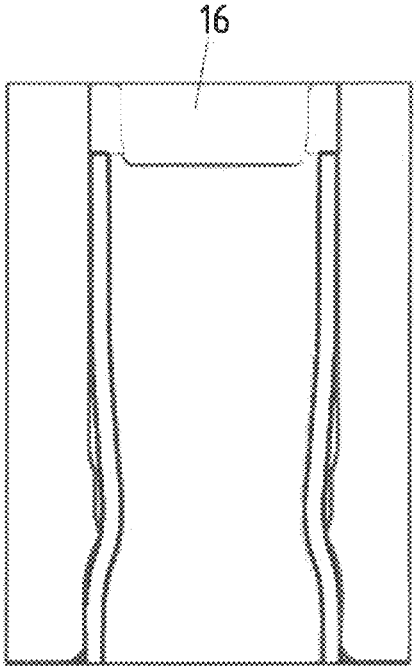
Fig. 5.1
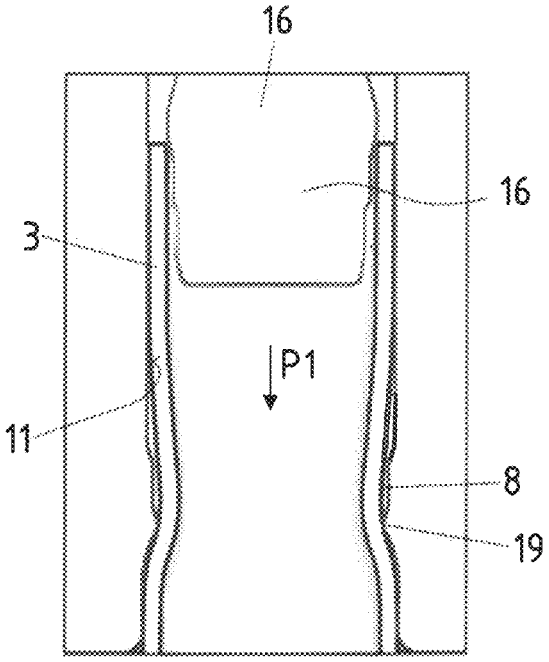
Fig. 5.2
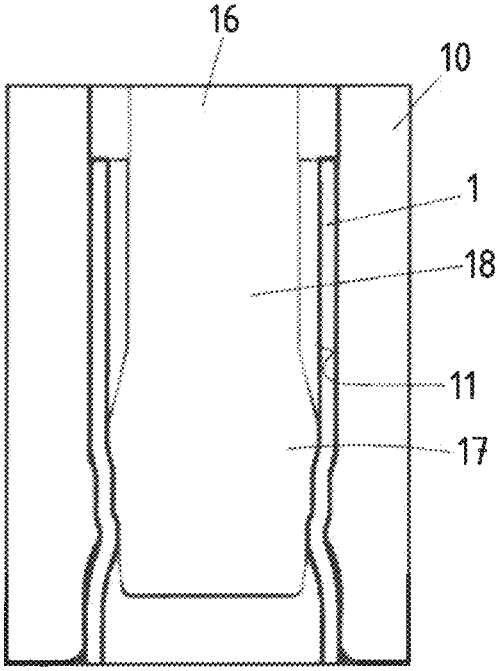
Fig. 5.3
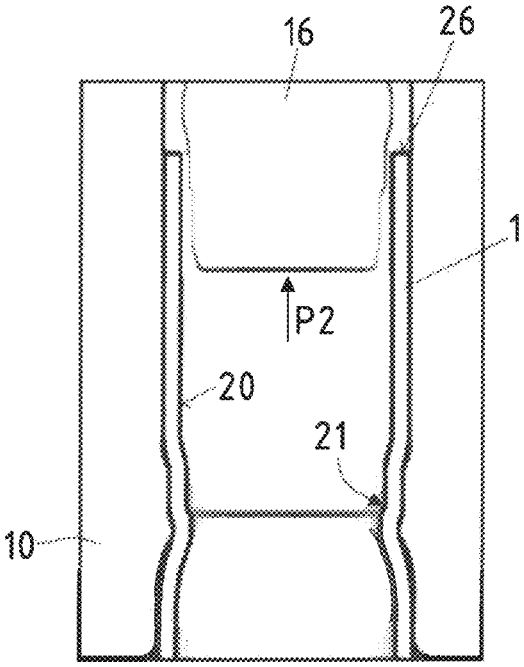
Fig. 5.4

METHOD FOR THE PRODUCTION OF AN INTERNAL STOP IN A TUBULAR COMPONENT

CROSS-REFERENCES TO RELATED APPLICATIONS

This application claims the priority of German Patent Application, Serial No. 10 2020 132 822.2, filed Dec. 9, 2020, pursuant to 35 U.S.C. 119(a)-(d), the disclosure of which is incorporated herein by reference in its entirety as if fully set forth herein.

BACKGROUND OF THE INVENTION

The present invention relates to a method for the production of an internal stop in a tubular component.

The following discussion of related art is provided to assist the reader in understanding the advantages of the invention, and is not to be construed as an admission that this related art is prior art to this invention.

Conventional rolling process of embossments and similar geometries to produce an internal stop are relatively time-consuming. The production of individual depressions, which are dispersed over the circumference, is comparatively complex in terms of tool technology. Moreover, so-called roller burnishing and overrolling have proven to be disadvantageous when roller burnishing high-strength steel alloys in particular, which in the worst case can result in surface breakouts or pitting and/or rolling in of foreign bodies.

It would be desirable and advantageous to provide an improved method for the production of an internal stop both with regard to the expenditure of time and with regard to complexity in terms of tool technology.

SUMMARY OF THE INVENTION

According to one aspect of the present invention, a method includes positioning a tubular component of steel in relation to a first die having an inner diameter which is smaller than an outer diameter of the tubular component, reducing an inner diameter of a first end of the tubular component by a relative movement between the tubular component and the first die in an axial direction of the tubular component such as to produce a first conical area between the first end of reduced inner diameter and a second end of the tubular component, forming the first conical area by a relative movement of a second die in the axial direction of the tubular component in a direction of the second end of the tubular component, so as to create in a longitudinal section of the first conical area a circumferential embossment on an outside and a bead on an inside, with the bead having an inner diameter which is smaller than the reduced inner diameter of the first end, widening the first end of the tubular component by inserting an inner tool axially into the first end of the tubular component, while the tubular component is supported on an outside in a mold cavity of an outer tool, and forming an inner contour with an internal stop as an outer surface of the first end of the tubular component rests flatly in the mold cavity.

The invention resolves prior art problems by producing an internal stop in a tubular component using several method steps that are exclusively attributable to an axial forming process and advantageously to an axial cold forming process.

Initially, a tubular component of steel is provided with a first end and a second end. The second end should not be deformed within the scope of the method described here. It can be used as an abutment. The forming process takes place only in the area of the first end of the tubular component. Of course, there is no exclusion to execute other method steps at the second end.

The inner diameter of the first end is being reduced. This is realized through a relative movement between the tubular component and a first die which receives the tubular component on the inside. For this purpose, the first die has, at least in one area, an inner diameter, which is smaller than the outer diameter of the tubular component. The relative movement can be realized e.g. by displacing the first die with respect to the stationary tubular component. An axial forming process is involved. This axial forming process causes a reduction of the diameter only in the area of the first end. A conical transition is produced between the first and second ends, due to different diameter zones of the first die. On the mouth side, the first die has a diameter of such a size to enable the tubular component to be received in the first the in the first place. At a distance from the mouth-side end, the inner diameter of the first die is reduced in a conical transition zone, corresponding to the desired outer diameter and corresponding to the desired contour of the first end.

The next production step can be referred to as resetting in relation to the previously produced conical area of the tubular component. A second die is used which, however, does not act on the already formed cylindrical first length section of the first end, but only acts on the conical area in the transition between the formed first end and non-deformed second end. The conical area is deformed by being displaced radially inwards by the second die, which is only moved axially. A second conical area at a distance from the conical area, which has in the meantime been pressed radially inwards, is formed by the second die. The used steel bulges inwards in the area of the originally conical area, so as to establish a circumferential embossment radially on the outside. The embossment results in an inwardly protruding, circumferential bead.

In the next step, the first end is widened using an inner tool. The inner tool is inserted into the first end and displaced in axial direction. The first end is situated in a mold cavity of an outer tool. An inner contour with the desired internal stop is to be formed by bringing the radial outer surface of the first end to rest flatly in the mold cavity (calibration).

The final inner contour with the desired internal stop is produced by the final calibration using the inner tool. The inner contour is calibrated by having the material of the tubular component supported with its outer surface on the inside of the mold cavity. For the production of the internal stop during the calibration process, the mold cavity includes an inwardly projecting circumferential projection which engages in the concave depression in the outer surface in the area of the embossment. As a result, the inner tool can be pressed against the bead and the tubular component can be pressed against the projection and consequently the inner contour can be precisely defined, i.e. calibrated.

According to another advantageous feature of the invention, the inner tool can include a first inner tool to widen the first end and a second inner tool to subsequently form the inner contour in an area of the bead.

According to another advantageous feature of the invention, during formation of the inner contour a circumferential stepped shoulder which is spaced from an end face of the first end of the tubular component can be produced and can include a first step defined by an inner diameter and an adjacent second step defined by an inner diameter which is greater than the inner diameter of the first step, with the internal stop being formed in a transition zone between the first step and the second step.

Advantageously, the stepped shoulder running in a radial direction can be produced with the second inner tool. The internal stop can be formed in the transition zone between the first step and the second step, with the first step located at a greater distance to the first end of the tubular component. The diameter of the first and second steps increases towards the first end, i.e. in opposition to the axial forming direction.

All inner diameters that have been modified through forming are advantageously set smaller on the finished tubular component than the inner diameter of the length sections of the tubular component that have not been deformed. In other words, the inner diameter of the formed first end is smaller than the inner diameter of the non-deformed second end, even when the inner diameter of the first end was widened again in the second half of the process.

With regard to the gradations of the inner diameter, the area with the smallest inner diameter is furthest away from the first end. Therefore, the second step of greater inner diameter is situated anteriorly of the first step of smaller inner diameter in forming direction. This makes it possible to use a relatively simply constructed inner tool as calibration tool that can be manufactured without undercuts. Due to the purely axial forming process, it is not necessary to provide complex outer tools with radially displaceable punches which effect a radial deformation of the tubular component from the outside. The stepped shoulder enables an exact calibration within a relatively short length region.

For calibration, i.e. during the last forming stage, the mold cavity of the outer tool can be designed in such a way that the desired inner contour can be realized. At the same time, the outer contour is determined, with the outer contour also depending on the desired wall thickness in the respective area. Through the forming process in the area of the second step, a slightly greater wall thickness can be set than in non-deformed length sections of the tubular component. The second step of greater inner diameter is to some extent slightly compressed anteriorly of the bead during the calibration in the last forming step. Advantageously, when viewed over the entire formed area, the differences in wall thickness can be very small (<5% of the wall thickness) and amount, in particular in absolute numbers, to only a few tenths of a millimeter. The wall thickness is advantageously substantially constant.

The internal stop, which can be designed as a radially circumferential projection, does not necessarily have to extend within an axial plane. Advantageously, the internal stop can be rounded or chamfered. A rounded area is easier to produce, requires lower forming forces and also creates lower material stress within the tubular component.

According to another advantageous feature of the invention, the tubular component can be made of a high-strength steel alloy with a strength of Rm>780 MPa. Currently preferred is a tubular component made of a high-strength steel alloy with a strength of Rm>1050 MPa. The tubular component can be seamless or welded. A seamless tubular component can be quenched and tempered (hardened and tempered). Quenching and tempering can take place before or after cold drawing of a tube. When the tube is cold drawn after quenching and tempering, the tube may optionally be annealed stress relieved. After stress relieve annealing, the tube can be cut to the required length. When quenching and tempering takes place after cold drawing, it is advantageous to cut to length after quenching and tempering. The tubular component can be a portion of a tube which has been heat-treated and cold-drawn as described above.

In summary, a method according to the invention provides to first reduce the original inner diameter of the tubular component, and to form an inwardly directed bead and an embossment by a resetting process in the area of the conical transition, subsequently to widen the first end to a large extent again by using an inner tool, advantageously an conical inner tool, and finally to form the desired inner contour with the stop, which has been made possible by the bead/embossment previously produced by resetting. Any of the process steps (reducing, resetting, widening, calibrating) may be carried out as cold forming. Pure cold forming without additional active heat input shortens the duration of the production process, is cost-effective, and comparatively easy to implement. In combination with the pure axial forming process, the tool costs are reduced at the same time.

According to another advantageous feature of the invention, the tubular component can be produced as a housing of a gas generator module, with the internal stop providing a positional orientation of an inner component of the gas generator module. The axial forming process according to the invention, in particular as pure cold forming process, can be carried out on a combustion chamber side of the housing to be produced. The combustion chamber side or the first end has different functions than the opposite second end of the housing.

The housing may involve essentially a cylindrical tubular component that undergoes a forming process in certain areas. When the gas generator is activated, the tubular component has to withstand very high loads for a short period of time, i.e. must be burst-proof in particular. Typical wall thicknesses are in the range of about 2 mm with outer diameters of about 30 mm.

BRIEF DESCRIPTION OF THE DRAWING

Other features and advantages of the present invention will be more readily apparent upon reading the following description of currently preferred exemplified embodiments of the invention with reference to the accompanying drawing, in which:

FIGS. 2.1-2.4 illustrate a chronological sequence of four production steps in a first forming tool;

FIGS. 3.1-3.4 illustrate a chronological sequence of four production steps in a second forming tool;

FIGS. 4.1-4.4 illustrate a chronological sequence of four production steps with a third forming tool;

FIGS. 5.1-5.4 illustrate a chronological sequence of four production steps with a fourth forming tool;

DETAILED DESCRIPTION OF PREFERRED EMBODIMENTS

Figure 1:
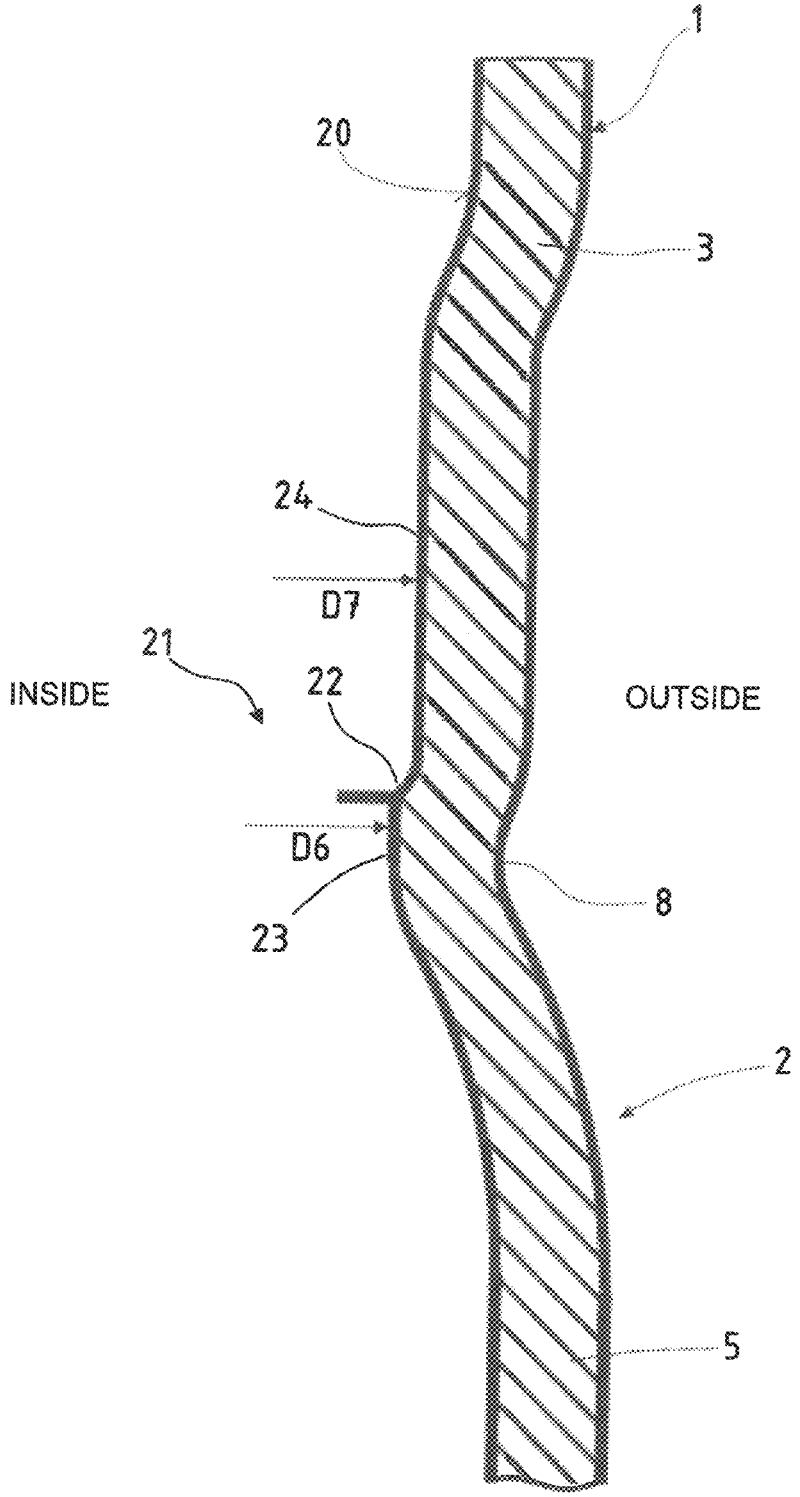
FIG. 1 is a simplified illustration of a longitudinal section through a formed area of a tubular component as housing of a gas generator module.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments may be illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown by way of example a longitudinal section of a portion of a tubular housing 2 of a gas generator module. The tubular housing 2 is made from an originally cylindrical tubular component 1, with the further production steps involving an axial cold forming process being explained with reference to FIGS. 2.1-5.4. FIG. 1 shows the tubular component 1 with a first end 3 and a second end 5. The tubular component 1 is formed with an embossment 8 that is designed to run circumferentially radially on the outside and to have different diameter zones (inner diameters D6 and D7) at first and second steps 23, 24 of a stepped shoulder 21, with an internal stop 22 being formed between the steps 23, 24.

The tubular component 1 is advantageously made of high-strength steel with a strength Rm of >780 MPa. Currently preferred is the use of a tubular component 1 made of high-strength steel with a strength Rm of >1050 MPa. According to the illustration of FIG. 2.1 the tubular component 1 is positioned on a first die 4. As indicated in FIG. 2.2, the first die 4 has an inner diameter D2 which is smaller than an outer diameter D1 of the tubular component 1. In a manner not shown in detail, the second end 5 of the tubular component is axially supported and/or held. The first die 4 is axially displaced in a direction of arrow P1. The original inner diameter D3 of the tubular component 1 is being reduced to a smaller inner diameter D4.

FIG. 2.3 shows the lower end position of the first die 4. FIG. 2.4 shows how the first die 4 is moved back into the starting position in a direction of arrow P2. The inner contour of the first die 4 with stepped inner diameter D2 has been transferred to the tubular component 1. A first conical area 6 was formed, which is situated between the non-deformed second end 5 and the deformed first end 3. As a result of the forming process, the first end 3 was slightly stretched. The transitions between the conical area 6 and the first and second ends 3 and 5 are rounded.

Resetting takes place in a second forming stage (FIGS. 3A-3.4). This means that the cylindrical part of the first end 3, which has already been formed, is not formed again, but rather the conical area 6. For this purpose, provision is made for a second die 7 which also has a gradation in order to form anew the first conical area 6. FIG. 3.2 shows how the second the 7 is displaced in a direction of arrow P1 in an axial direction. FIG. 3.3 shows the second the 7 in a lower end position. The first conical area 6 was deformed, with a circumferential embossment 8 and an inwardly protruding bead 25 now being produced in the original length area of the first conical area 6. The wall area at the level of the embossment 8 has shifted radially inwards. An inner diameter D5 of the bead 25 is smaller than the inner diameter D4 of the already formed cylindrical first end 3.

The embossment 8, which is designed to run circumferentially radially on the outside, is followed in axial direction by a second widening conical area 9 which is formed by the second die 7 and represents the transition to the second end 5 of the tubular component 1, which second end 5 remains non-deformed. The transitions are smooth. The second conical area 9 is steeper than the first conical area 6 as a result of the corresponding shape of the second die 7, as can be seen from a comparison of FIGS. 2.4 and 3.4. FIGS. 2.4 and 3.4 each show the first and second dies 4 and 7 during the upward movement in the direction of arrow P2 and at the same time the tubular component 1 as a result of the respective formation stage.

FIGS. 4.1 to 4.4 show the next production step. The tubular component 1 with the contour according to FIG. 3.4 is inserted in an outer tool 10 with a mold cavity 11. The mold cavity 11 is contoured, i.e. it is not exclusively cylindrical, and determines the later outer shape of the tubular component 1.

An inner tool 12 is inserted in the direction of arrow P1 from the first end 3 into the tubular component 1, so that the tubular component 1 is widened. The first inner tool 12 has a frustoconical tip 13, which is followed by a cylindrical shaft 14. Corresponding to the contour of the first inner tool 12, a cylindrical contour is accordingly produced in the upper region of the first end 3 of the tubular component 1 and a conical contour is produced in the region in which the tip 13 comes into contact with the tubular component 1, approximately up to the level of the embossment 8 or of the inwardly directed bead 25.

FIG. 4.3 shows a lower end position of the first inner tool 12. FIG. 4.4 again shows the upward movement (arrow P2) of the first inner tool 12 in the outer tool 10 and the contour of the tubular component 1 after completion of this production step.

FIG. 4.4 also shows that the cylindrical outer surface 15 of the tubular component 1 rests upon the mold cavity 11 in the region of the first end 3. In the more strongly contoured areas adjacent to the embossment 8, the tubular component 1 does not yet rest upon the mold cavity 11 of the outer tool 10.

The final calibration is explained with reference to FIGS. 5.1-5.4. The tubular component 1 with the contour according to FIG. 4.4 is shown in FIG. 5.1. A second inner tool 16 has a head 17 with several gradations (FIG. 5.2). A slimmer shaft 18 adjoins the head 17 (FIG. 5.3). The second inner tool 16 has three stepped diameter zones as active surfaces for the forming process. The area of the head 17 with the greatest diameter comes initially into contact with the first end 3 of the tubular component 1 and calibrates the inner diameter of the first end 3 over the majority of its length.

The smaller diameter zones of the head 17 are situated anteriorly in axial direction and in the forming direction. Corresponding to the contour of the head 17, there are also two further diameter zones of smaller diameter in the mold cavity 11. In the area of the embossment 8, the mold cavity 11 has a projection 19 which engages in the embossment 8.

FIG. 5.3 shows a lower end position of the second inner tool 16. In the area of the projection 19, the embossment 8 in the wall of the tubular component 1 is pressed outwards against the mold cavity 11. The material is pressed in particular against the projection 19 of the mold cavity 11. The area with the smallest inner diameter is thereby formed, so that an inner contour 20 with a circumferential stepped shoulder 21 is created, as shown in FIG. 5.4.

In FIG. 5.4, the second inner tool 16 is in the phase of the upward movement in the direction of arrow P2. The formed tubular component 1 can now be removed from the outer tool 10.

Figure 6:
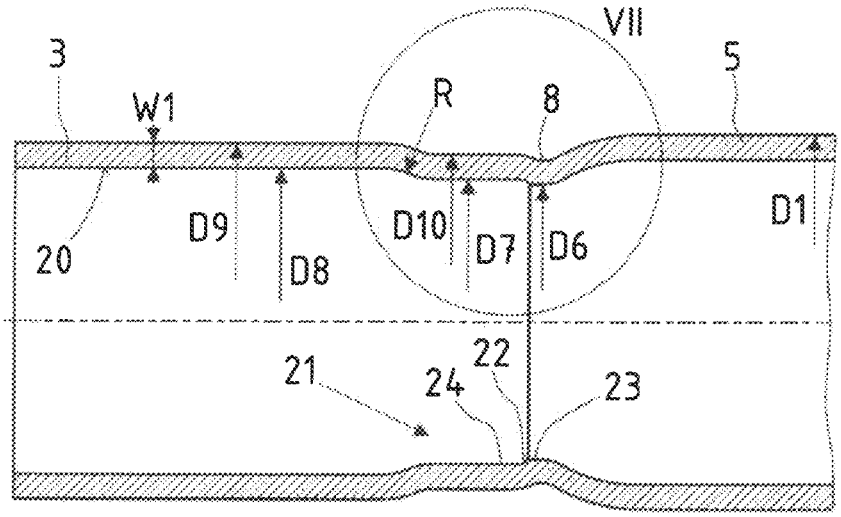
FIG. 6 is a detailed cutaway view of a formed first end of the tubular component.

FIG. 6 shows an enlarged illustration of the finished stepped shoulder 21, which is spaced from an end face 26 (FIG. 5.4) of the first end 3 of the tubular component 1. The stepped shoulder 21 has an internal stop 22 which is arranged at a transition zone between the first step 23 of smaller inner diameter D6 and the second step 24 of greater inner diameter D7 along the transition zone. The greater second step 24 is situated anteriorly of the smaller first step 23 in accordance with the contour of the second inner tool 16.

Figure 7:
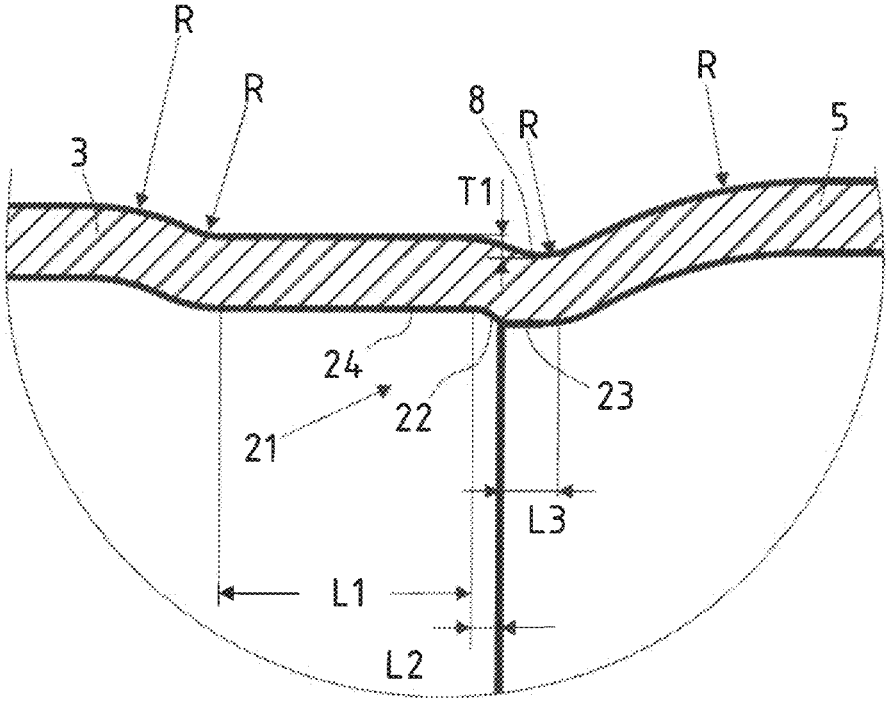
FIG. 7 is an enlarged detailed view of the area encircled in FIG. 6 and marked VII.

FIGS. 6 and 7 show further details in the area of the stepped shoulder 21. The greater step 24 has a greater axial length L1 than the rounded stop 22, which has a length L2. In addition, the length L1 of the greater step 24 is also greater than the length L3 of the step 23 of smaller diameter. The length L3 of the smaller step 23 is greater than the length L2 of the stop.

FIGS. 6 and 7 further show that the end-side length region of the first end 3, which end-side length region is disposed anteriorly of the formed stepped shoulder 21 and which is also essentially cylindrical, has a greater inner diameter D8 than the inner diameter D7 of the greater second step 24. At the same time, the wall thickness W1 is substantially constant over the entire forming area. There is only a slight thickening in the area of the greater second step 24, which in this exemplary embodiment is approximately 1/10 mm. The outer diameter D1 is preferably in a range of 20 mm-50 mm with wall thicknesses W1 of 1.5 mm-3 mm and with a thickening of the wall thickness W1 of 5%-20%.

FIGS. 6 and 7 further show radii R. The radii R have different sizes. All transitions are smooth, except between the internal stop 22 and the smaller first step 23. Diameter information is only given in the essentially cylindrical areas. The outer diameter D9 in the formed area with the greatest diameter is smaller than the outer diameter D10 of the greater second step 24. In addition, the ratio between the outer diameters D1, D9 at the non-deformed second end 5 and in the deformed area can be governed by the following equation: $D9=0.9-1.0\times D1$.

In the length region of the internal stop 22, the embossment 8 has a rounded transition radially on the outside toward the second step 24 with greater outer diameter D10. The depth T1 of the embossment 8 in relation to the outer diameter D10 of the greater second step 24 is in a range from 0.3 mm-1 mm. The rounded embossment 8 merges into the non-deformed area of the second end 5 via a further rounded transition with the radius R.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A method, comprising the steps of:

positioning a tubular component of steel in relation to a first die having an inner diameter which is smaller than an outer diameter of the tubular component;

reducing an inner diameter of a first end of the tubular component by a relative movement between the tubular component and the first die in an axial direction of the tubular component such as to produce a first conical area between the first end of reduced inner diameter and a second end of the tubular component;

forming the first conical area by a relative movement of a second die in the axial direction of the tubular component in a direction of the second end of the tubular component, so as to create in a longitudinal section of the first conical area a circumferential embossment on an outside and a bead on an inside, with the bead having an inner diameter which is smaller than the reduced inner diameter of the first end;

widening the first end of the tubular component by inserting an inner tool axially into the first end of the tubular component, while the tubular component is supported on an outside in a mold cavity of an outer tool; and forming an inner contour with an internal stop as an outer surface of the first end of the tubular component rests flatly in the mold cavity.

2. The method of claim 1, further comprising producing during formation of the inner contour a circumferential stepped shoulder which is spaced from an end face of the first end of the tubular component and includes a first step defined by an inner diameter and an adjacent second step defined by an inner diameter which is greater than the inner diameter of the first step, with the internal stop being formed in a transition zone between the first step and the second step.

3. The method of claim 2, wherein the inner diameter of the second step is smaller than the inner diameter of the first end of the tubular component which first end is situated anteriorly of the second step.

4. The method of claim 2, wherein during formation of the inner contour in an area of the second step a wall thickness is produced which is greater than a wall thickness in a non-deformed length section of the tubular component.

5. The method of claim 2, wherein the second step is produced with an axial length which is greater than an axial length of the first step.

6. The method of claim 1, wherein the tubular component is produced as a housing of a gas generator module, with the internal stop providing a positional orientation of an inner component of the gas generator module.

7. The method of claim 6, wherein the method is carried out on a combustion chamber side of the housing to be produced.

8. The method of claim 1, wherein the inner tool includes a first inner tool to widen the first end and a second inner tool to subsequently form the inner contour in an area of the bead.

9. The method of claim 1, wherein the internal stop is rounded or chamfered.

10. The method of claim 1, wherein the tubular component is made of a high-strength steel alloy with a strength of Rm>780 MPa.

11. The method of claim 1, wherein the tubular component is made of a high-strength steel alloy with a strength of Rm>1050 MPa.

12. The method of claim 1, wherein at least one of the forming steps is carried out as a cold forming process.

* * * * *